US010103476B1

(12) United States Patent
Qiu et al.

(10) Patent No.: US 10,103,476 B1
(45) Date of Patent: Oct. 16, 2018

(54) DDR SOCKET CONNECTOR

(71) Applicant: Amphenol East Asia Electronic Technology (Shen Zhen) Co., Ltd., Shenzhen (CN)

(72) Inventors: Fuding Qiu, Shenzhen (CN); Chunguo Zuo, Shenzhen (CN); Fuan Jiang, Shenzhen (CN); Yitao Zhang, Shenzhen (CN); Liang Liu, Shenzhen (CN)

(73) Assignee: Amphenol East Asia Electronic Technology (Shen Zhen) Co., Ltd., Shenzhen (CN)

( * ) Notice: Subject to any disclaimer, the term of this patent is extended or adjusted under 35 U.S.C. 154(b) by 0 days.

(21) Appl. No.: 15/673,869

(22) Filed: Aug. 10, 2017

(51) Int. Cl.

| | |
|---|---|
| ***H01R 24/00*** | (2011.01) |
| ***H01R 13/50*** | (2006.01) |
| ***H01R 13/516*** | (2006.01) |
| ***H01R 13/10*** | (2006.01) |

(52) U.S. Cl.
CPC ..... *H01R 13/50* (2013.01); *H01R 13/10* (2013.01); *H01R 13/516* (2013.01); *H01R 2201/06* (2013.01)

(58) Field of Classification Search
CPC .... H01R 13/50; H01R 13/6471; H01R 13/26; H01R 13/516; H01R 13/10; H01R 2201/06; H01R 13/326; H05K 7/1431
USPC ..... 439/660
See application file for complete search history.

(56) References Cited

U.S. PATENT DOCUMENTS

| | | | | |
|---|---|---|---|---|
| 5,169,333 | A * | 12/1992 | Yang Lee | H05K 7/1431 439/326 |
| 2013/0052865 | A1* | 2/2013 | Lee | H01R 13/6471 439/607.01 |
| 2016/0103152 | A1* | 4/2016 | Yang | G11C 29/56016 324/756.02 |
| 2017/0294728 | A1* | 10/2017 | Zuo | H01R 13/26 |

* cited by examiner

*Primary Examiner* — Jean F Duverne
(74) *Attorney, Agent, or Firm* — Maier & Maier, PLLC

(57) ABSTRACT

The present application relates to DDR connectors, particularly to a new DDR socket connector. The DDR socket connector comprises two fastening posts, an insert and a plugging groove. Each of the fastening posts are made of plastic and located at two sides of the groove. The insert is embedded in one of the two fastening posts and made of metal, and the insert includes a main body and two side parts. The main body is located in the middle portion of the insert, and the side parts are located at two sides of the main body. Compared with the prior art, the beneficial effects of the present application lie in: the plastic connecting part is inserted with a metal insert to overcome such deficiencies as plastic getting weak when being heated and thus eliminate the adverse impact of high temperature on the product.

5 Claims, 3 Drawing Sheets

DDR SOCKET CONNECTOR

TECHNICAL FIELD

The present application relates to DDR connectors, particularly to a new DDR socket connector.

BACKGROUND

As connectors for connecting memory modules with circuit boards, DDR memory sockets are usually of surface-pad type (which is simply referred to as pad type), through-hole welding type and through-hole crimping type. Among others, in case of surface-pad type memory socket, a memory socket placed on a solder paste coated circuit board is heated with a soldering equipment. The solder paste on the circuit board melts at high temperature and then cools, soldering the socket and the circuit board together.

The two side connecting parts of a memory socket of surface-pad type are made of plastic, which become very weak after the melting and cooling process of the socket within a solder equipment. The connecting parts will be split upon plugging in or pulling out in oblique directions. Split products fail to meet the requirements of a normal use.

SUMMARY

To solve the above described technical problems, the present application provides a new DDR socket connector with anti-split ability.

Specifically, the technical solutions of the application are detailed as follows: the new DDR socket connector comprises two fastening posts, an insert and a plugging groove.

The fastening posts are made of plastic and located at two sides of the plugging groove. The insert is embedded in one of the two fastening posts and made of metal, and the insert includes a main body and two side parts. The main body is located in the middle portion of the insert, and the side parts are located at two sides of the main body.

In a further optimized technical solution, the cross section of the main body is of M-shape in a direction perpendicular to the plugging groove; and the main body includes at its bottom three legs which are connected with the fastening post.

In a further optimized technical solution, the cross section of the main body is of n-shape in a direction parallel to the plugging groove; and the main body includes at its bottom two flaps which are connected with the fastening post.

Employing the above mentioned technical solutions, the following beneficial effects could be obtained by the present application.

As compared with the disclosed technical solutions, the new DDR socket connector has an innovation in that: each of two plastic connecting parts is inserted with a metal insert to overcome such deficiencies as plastic getting weak when being heated and thus eliminate the adverse impact of high temperature on the product. In particular, the main body plays a major role in strengthening the plastic connecting part and meanwhile the two side parts of the main body assists in strengthening as well.

In an optimized solution, the cross section of the main body is M-shape structured, the body includes at its bottom three legs which will be connected with one of the two fastening posts. These features help in strengthening the two side connecting parts of the memory socket, overcoming such deficiencies as plastic getting weak when heated and enhancing the anti-split ability of the whole insert in a direction perpendicular to the plugging groove.

In an optimized solution, the cross section of the main body is n-shape structured, and the body includes at its bottom two edges which will be connected with the two fastening posts. These help in strengthening the two side connecting parts of the memory socket, overcoming such deficiencies as plastic getting weak when heated and enhancing the anti-split ability of the whole insert in a direction parallel to the plugging groove.

DETAILED DESCRIPTION

Figure 1:
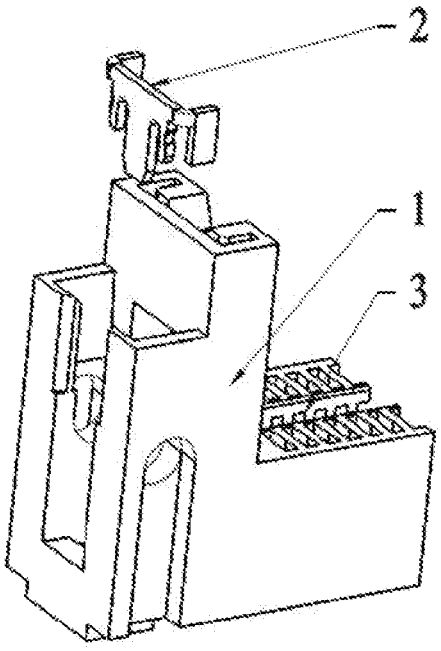
FIG. 1 is an exploded view of a new DDR socket connector (M-shape structured)
Figure 2:
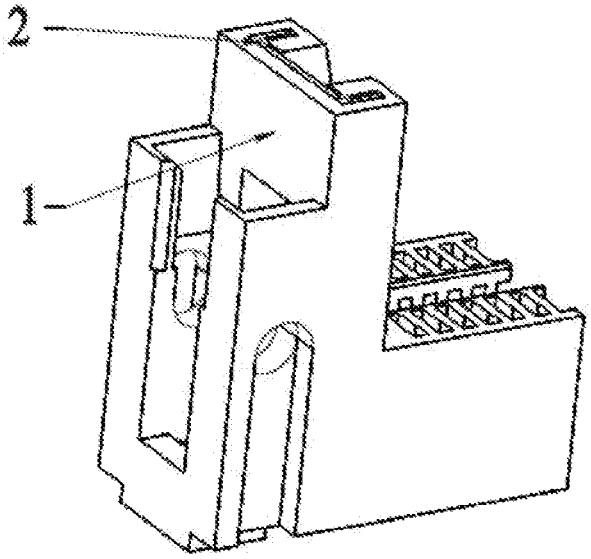
FIG. 2 is an assembly view of a new DDR socket connector (M-shape structured)

The present application will be detailed in connection with FIGS. 1 to 6 and the specific embodiments as well, which are in no way intended to limit the present application.

Embodiment 1

As shown in FIGS. 1, 2, 4 and 5, a new DDR socket connector comprises two fastening posts 1 (with only one shown in the figures), an insert 2 and a plugging groove 3.

Each of the fastening posts 1 is made of plastic and located respectively at two sides of the groove 3. The insert 2 is inserted in one of the two fastening posts 1 and made of metal, and the insert 2 includes a main body 21 and two side parts 22. The main body 21 is located in the middle portion of the insert 2, and the side parts 22 are located at two sides of the body 21.

Embodiment 2

Figure 3:
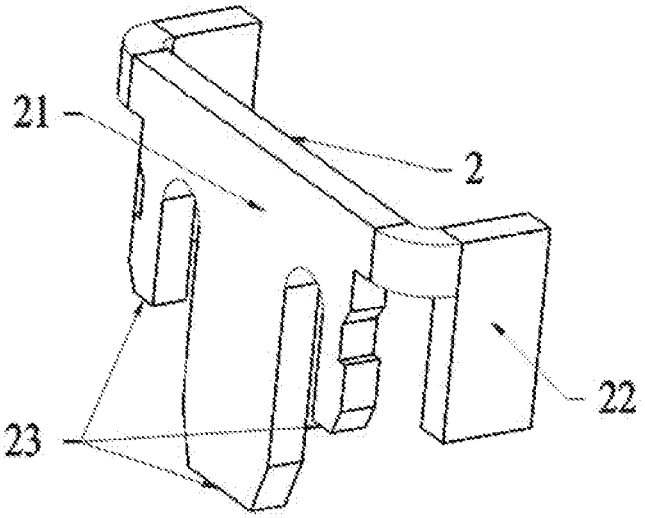
FIG. 3 is a perspective view of an insert (M-shape structured)
Figure 4:
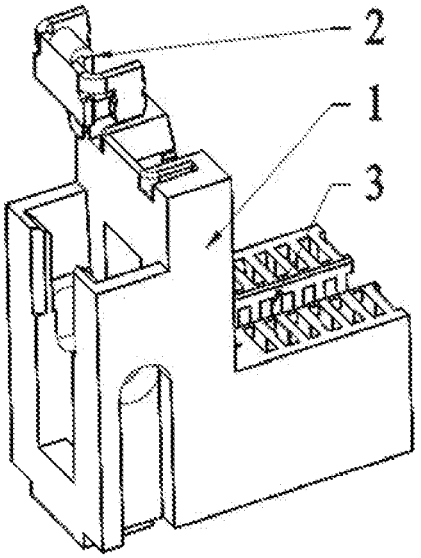
FIG. 4 is an exploded view of a new DDR socket connector (n-shape structured)
Figure 5:
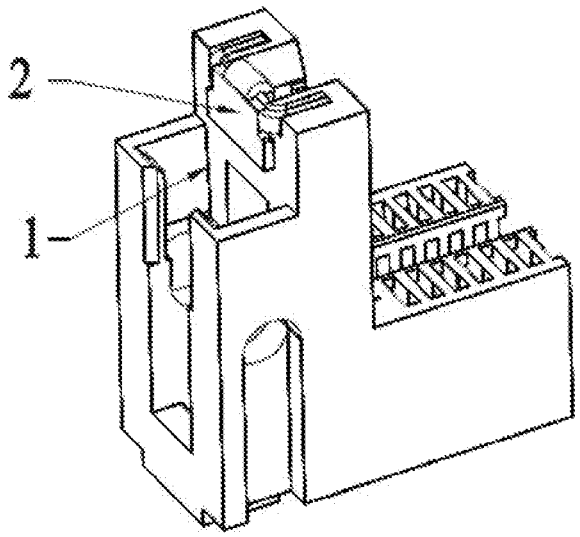
FIG. 5 is an assembly view of a new DDR socket connector (n-shape structured)

As shown in FIG. 3, on the basis of embodiment 1, the cross section of the main body 21 is M-shape structured in a direction perpendicular to the plugging groove 3; the body 21 includes at its bottom three legs 23 which will be connected with one of the two fastening posts 1 to strengthen the two side connecting parts of the memory socket, and overcome such deficiencies as plastic getting weak when heated and thus enhance the anti-split ability of the whole insert in the direction perpendicular to the plugging groove 3. The two side parts 22 of the main body 21 help in strengthening as well.

Embodiment 3

Figure 6:
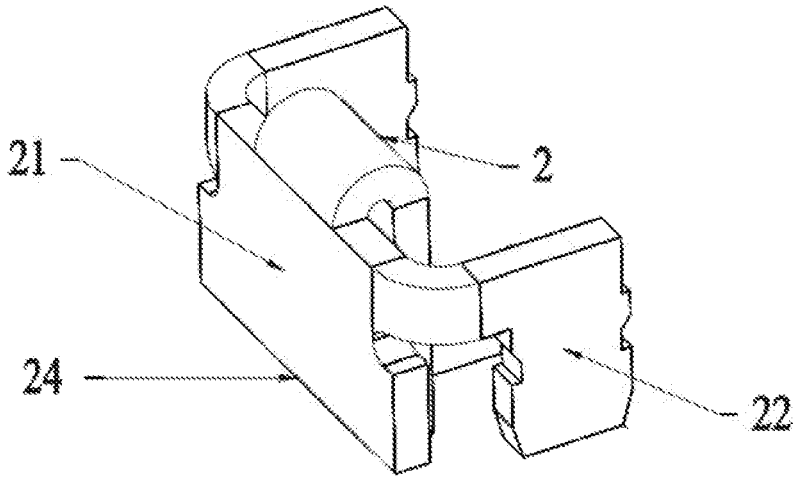
FIG. 6 a perspective view of an insert (n-shape structured).

As shown in FIG. 6, on the basis of embodiment 1, the cross section of the main body 21 is n-shape structured in a direction parallel to the plugging groove 3; the body 21 includes at its bottom two flaps 24 which will be connected with one of the two fastening posts 1 to strengthen the two side connecting parts of the memory socket, overcome such deficiencies as plastic getting weak when heated and thus enhance the anti-split ability of the whole insert in the direction parallel to the plugging groove 3. The two side parts 22 of the main body 21 help in fastening as well.

In light of general technical knowledge, the present technical solutions can be achieved by other embodiments which do not depart from spiritual substance or essential features of the application. Therefore, the above described embodiments are simply illustrative rather than exclusive in any way. All changes within the range of the application or its equivalent are included in the scope of the application itself.

What is claimed is:

1. A new DDR socket connector, comprising two fastening posts, an insert and a plugging groove;

wherein the fastening posts are made of plastic and located at two sides of the plugging groove;

wherein the insert is embedded in one of the two fastening posts and made of metal, and the insert includes a main body having at least three projections formed thereon, the at least three projections including two side parts and at least one other projection;

wherein the main body is located in the middle portion of the insert;

wherein the side parts are located at two sides of the main body; and wherein the at least three projections are configured to extend from the main body in a direction parallel to the plugging groove and are configured to interface with the plugging groove, each of the at least three projections having a proximal end disposed at a position contacting the main body and having a distal end located between a lowest point of the main body and the plugging groove.

2. The new DDR socket connector as set forth in claim 1, wherein the cross section of the main body is of M-shape in a direction perpendicular to the plugging groove; and the main body includes at its bottom three legs which are connected with the fastening post, such that the at least three projections comprises the three legs and the two side parts.

3. The new DDR socket connector as set forth in claim 1, wherein the cross section of the main body is of n-shape in the direction parallel to the plugging groove; and the main body includes at its bottom two flaps which are connected with the fastening post, such that the at least three projections comprises a projection formed from the main body and the two side parts.

4. The new DDR socket connector as set forth in claim 2, wherein the three legs are linearly aligned along a first face of the main body, and wherein the three legs comprise a central leg and two outside legs each having a height smaller than that of the central leg, each of the outside legs having a variable-width shape configured to interface with one of the two fastening posts.

5. The new DDR socket connector as set forth in claim 3, wherein each of the side parts has a variable-width shape configured to interface with one of the two fastening posts.

* * * * *